US008162041B2

(12) United States Patent
Kaga et al.

(10) Patent No.: US 8,162,041 B2
(45) Date of Patent: Apr. 24, 2012

(54) HEAT EXCHANGER OF PLATE FIN AND TUBE TYPE

(75) Inventors: Kunihiko Kaga, Tokyo (JP); Shinji Nakadeguchi, Tokyo (JP); Akira Ishibashi, Tokyo (JP); Shinichi Wakamoto, Tokyo (JP); Toshinori Ohte, Tokyo (JP); Hiroki Murakami, Tokyo (JP); Tadashi Saito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 218 days.

(21) Appl. No.: 12/503,141

(22) Filed: Jul. 15, 2009

(65) Prior Publication Data

US 2009/0301698 A1 Dec. 10, 2009

Related U.S. Application Data

(63) Continuation of application No. 10/557,604, filed as application No. PCT/JP2004/007396 on May 21, 2004, now Pat. No. 7,578,339.

(30) Foreign Application Priority Data

May 23, 2003 (JP) ..... 2003-146218

(51) Int. Cl.
*F28F 1/32* (2006.01)

(52) U.S. Cl. ..... 165/151; 165/182

(58) Field of Classification Search ..... None
See application file for complete search history.

(56) References Cited

U.S. PATENT DOCUMENTS

| | | | |
|---|---|---|---|
| 3,916,989 | A | 11/1975 | Harada et al. |
| 4,821,795 | A | 4/1989 | Lu |
| 4,830,102 | A | 5/1989 | Bakay et al. |
| 5,697,432 | A | 12/1997 | Yun et al. |
| 5,875,839 | A | 3/1999 | Kim et al. |
| 5,890,532 | A | 4/1999 | Kim et al. |
| 5,915,471 | A | 6/1999 | Kim |
| 5,927,392 | A | 7/1999 | Youn et al. |
| 5,947,194 | A | 9/1999 | Baek et al. |
| 5,975,199 | A | 11/1999 | Park et al. |
| 6,227,289 | B1 | 5/2001 | Yokoyama et al. |
| 2003/0150601 | A1 | 8/2003 | Park et al. |
| 2004/0194936 | A1 | 10/2004 | Torii |

FOREIGN PATENT DOCUMENTS

| | | | |
|---|---|---|---|
| JP | 56-130597 | A | 10/1981 |
| JP | 58-158497 | A | 9/1983 |
| JP | 61-46898 | A | 3/1986 |
| JP | 2-147679 | U | 12/1990 |

(Continued)

*Primary Examiner* — Allen Flanigan
(74) *Attorney, Agent, or Firm* — Leydig, Voit & Mayer, Ltd.

(57) ABSTRACT

A heat exchanger including plate fins stacked at respective intervals relative to one another, and heat exchanger tubes penetrating the fins in. The heat exchanger exchanges heat between first and second fluids flowing, respectively, inside and outside the heat exchanger tubes. Each of the fins includes a substantially planar main body and cut-raised portions extending from the main body and disposed at an upstream side of flow of the second fluid. Each of the cut-raised portions corresponds to a respective heat exchanger tube and includes first and second opposed side ends connected to the main body of the fin. The first side end is nearer to the corresponding heat exchanger tube than is the second side end, the first side end is longer than the second side end, and the first side end is disposed at a downstream side of the flow of the second fluid, facing the corresponding heat exchanger tube.

6 Claims, 9 Drawing Sheets

FOREIGN PATENT DOCUMENTS

| | | | |
|---|---|---|---|
| JP | 4-15494 | A | 1/1992 |
| JP | 6-300474 | A | 10/1994 |
| JP | 8-291988 | A | 11/1996 |
| JP | 9-152288 | A | 6/1997 |
| JP | 10-89874 | A | 4/1998 |
| JP | 10-89875 | A | 4/1998 |
| JP | 10-89876 | A | 4/1998 |
| JP | 10-197182 | A | 7/1998 |
| JP | 10-206056 | A | 8/1998 |
| JP | 10-300375 | A | 11/1998 |
| JP | 10-300377 | A | 11/1998 |
| JP | 10-339594 | A | 12/1998 |
| JP | 11-118380 | A | 4/1999 |
| JP | 11-281279 | A | 10/1999 |
| JP | 2001-280880 | A | 10/2001 |
| JP | 2002-31434 | A | 1/2002 |
| JP | 2002-90085 | A | 3/2002 |
| JP | 2002-156192 | A | 5/2002 |

HEAT EXCHANGER OF PLATE FIN AND TUBE TYPE

TECHNICAL FIELD

The present invention relates to a heat exchanger of plate fin and tube type in which a fin attached onto the outer-periphery of a heat exchanger tube is formed with a cut-raised portion for providing enhanced heat exchange efficiency.

BACKGROUND ART

A plate fin and tube type heat exchanger which comprises a plurality of fins stacked while leaving a given space therebetween, and a plurality of heat exchanger tubes penetrating the fins in the stacking direction, is widely used, for example, as a condenser or evaporator for air-conditioners. For example, this type of heat exchanger is designed to perform a heat exchange between a first working fluid, such as water or chlorofluorocarbon, allowed to flow inside the heat exchanger tubes, and a second working fluid, such as air, allowed to flow outside the heat exchanger tubes or the spaces between the stacked fins, through the heat exchanger tubes and the fins.

Generally, in the conventional heat exchanger of this type, a cut-raised portion has been formed in each of the fins through a press working or other process to provide enhanced heat exchanger efficiency (see, for example, Japanese Patent Laid-Open Publication Nos. 08-291988, 10-89875, 10-197182, 10-206056 and 2001-280880). The cut-raised portion is typically formed in the region of the fin between adjacent ones of the group of heat exchanger tubes aligned in a direction perpendicular to the general flow direction of the second working fluid outside the heat exchanger tubes (see FIG. 17). The cut-raised portion is formed such that its two opposite edges disconnected from the body of the fin extend in a direction approximately perpendicular to the flow direction of the second working fluid. If such a cut-raised portion is not formed in the fin, a temperature boundary layer will be developed on the surface of the fin along the flow of the second working fluid to hinder the heat transfer between the second working fluid and the fin. By contrast, if the cut-raised portion is formed, the renewal of the temperature boundary layer will be induced to facilitate the heat transfer between the fin and the second working fluid.

For example, in case where the plate fin and tube type heat exchanger is used in an outdoor unit of an air-conditioner, the heat exchanger is likely to be inevitably operated under the conditions causing frost buildup thereon. In such a case, if the fin is formed with the cut-raised portion, frost will be liable to be created and grown at and around the cut-raised portion to block up the space between the adjacent fins.

Thus, in case where this type of heat exchanger is used under such conditions, for example, in an outdoor unit of an air-conditioner, the cut-raised portion cannot be formed in the fin, resulting in deteriorated heat exchange efficiency. As measures for obtaining adequate heat exchange efficiency in this situation, it is conceivable to increase the size of the heat exchanger itself, or to increase the speed of a fan to provide an increased flow volume of the second working fluid. However, these measures involve problems, such as increase in installation area, material cost, fan-driving energy and noises.

DISCLOSURE OF INVENTION

In view of the above conventional problems, it is therefore an object of the present invention to provide a plate fin and tube type heat exchanger capable of preventing the space between fins from being blocked by frost even under the operational conditions causing frost buildup, while maintaining adequate heat exchange efficiency and compact size.

In order to achieve this object, the present invention provides a heat exchanger of plate fin and tube type including a plurality of fins stacked at given intervals to one another, and a plurality of heat exchanger tubes penetrating the fins in the fin-stacking direction. The heat exchanger is designed to perform a mutual heat exchange between a fluid inside the heat exchanger tubes and another fluid outside the heat exchanger tubes, through the heat exchanger tubes and the fins. In this heat exchanger, each of the fins is provided with a plurality of cut-raised portions. One or more cut-raised portion(s) is (are) associated with the corresponding one of the heat exchanger tubes, substantially only in a region of the fin satisfying the following relationship.

$$Ws=(1-\phi)Dp+\phi D$$

$$\phi>0.5$$

Hereupon, Ws is an entire spread width of the cut-raised portion(s) in a direction extending along an end of the fin on the upstream side of fluid outside the heat exchanger tubes (hereinafter referred to as "column direction"). D is an outer diameter of each of the heat exchanger tubes. Dp is an alignment pitch of the heat exchanger tubes in the column direction.

According to the heat exchanger of the present invention, the cut-raised portions formed in the fin on the upstream side and/or downstream side of the second fluid can induce the segmentation or renewal of a temperature boundary layer. This allows the heat exchanger to have enhanced heat exchanger efficiency and reduced size.

In addition, a zone formed with no cut-raised portion exists in the fin between the heat exchanger tubes aligned in the column direction. Thus, in case where the second fluid is air, and the heat exchanger is operated under the conditions causing frost buildup, even if the space between the adjacent fins is blocked in the vicinity of the cut-raised portions due to frost buildup, the air can flow through the zone with no cut-raised portion so as to suppress the reduction in air flow volume of the heat exchanger as a whole. Thus, even during the operation under the frost-buildup conditions, the heat exchange efficiency can be maintained in a high level. The cut-raised portion may be formed to extend obliquely relative to the column direction, so that the air can be directed toward a zone of the fin with no airflow-on the downstream side of the heat exchanger tube to provide further enhanced heat exchange efficiency.

The cut-raised portion may also be formed in a bridge shape. In this case, the outer surface of a leg segment of the bridge connected to the body of the fin may be disposed in opposed relation to the heat exchanger tube to prevent the cut-raised portion from blocking the heat transfer from the heat exchanger tube. This allows heat from the heat exchanger tube to be effectively transferred to a region of the fin far from the heat exchanger tube.

BRIEF DESCRIPTION OF DRAWINGS

Other features and advantages of the present invention will be apparent from the detailed description and from the accompanying drawings. In the accompanying drawings, a common element or component is defined by the same reference numeral.

BEST MODE FOR CARRYING OUT THE INVENTION

With reference to the accompanying drawings, various embodiments of the present invention will now be specifically described.

First Embodiment

Figure 1A:
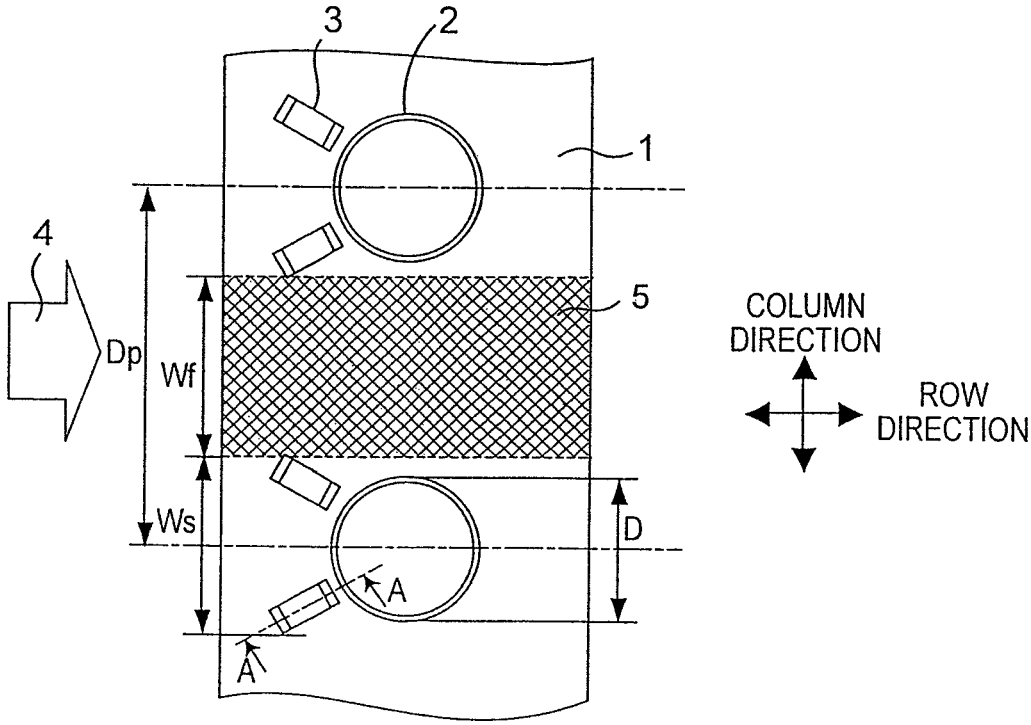
FIG. 1A is a schematic diagram of a heat exchanger according to a first embodiment of the present invention, seeing from the side of one of the ends of a heat exchanger tube thereof.
Figure 1B:
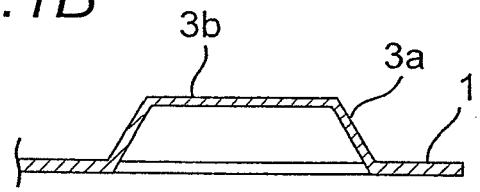
FIG. 1B is a sectional view taken along the line A-A in FIG. 1A.

As shown in FIGS. 1A and 1B, a heat exchanger according to a first embodiment of the present invention comprises a plurality of fins 1 (FIG. 1A shows only one of the fins) stacked while leaving a given space therebetween, and a plurality of heat exchanger tubes 2 penetrating the fins 1 in the stacking direction. Each of the fins 1 is formed with plural pairs of cut-raised portions 3 (or plurality of cut-raised portion pairs 3) each associated with the corresponding one of the heat exchanger tube 2. The heat exchanger is designed to perform a heat exchange between a first working fluid (e.g. heat transfer medium for air-conditioners) (not shown) allowed to flow inside the heat exchanger tubes, and a second working fluid 4 (e.g. air) allowed to flow outside the heat exchanger tubes, through the fin 1 and the heat exchanger tubes 2.

In the heat exchanger illustrated in FIGS. 1A and 1B, the plurality of heat exchanger tubes 2 are aligned in a given alignment pitch in one direction (hereinafter referred to as "column direction) along an ends of the fin on the upstream side of the general flow (from left side to right side in FIG. 1) of the second working fluid 4 allowed to flow outside the heat exchanger tubes (the upstream side and the downstream side of the general flow of the second working fluid 4 are hereinafter referred to as "upper side" and "down side", respectively), and another direction (hereinafter referred to as "row direction") perpendicular to the column direction. While FIG. 1A shows only one line of the heat exchanger tubes 2 in the row direction, it is understood that two or more lines may be provided.

The plurality of cut-raised portions 3 are sub-grouped into the plural pairs of cut-raised portions 3 each disposed on the upper side of the corresponding one of the heat exchanger tubes 2. Each of the cut-raised portions 3 is cut and raised from the body of the fin to form a bridge shape which has a leg segment 3*a* connected to the fin body, and a beam segment 3*b* with two opposite edges disconnected from the fin body (hereinafter referred to as "edges" for brevity).

Figure 2:
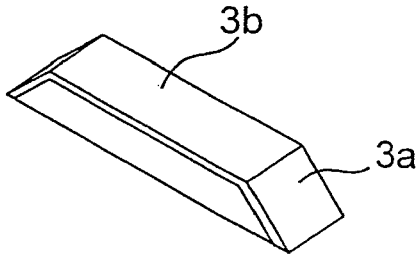
FIG. 2 is a perspective view of one example of a cut-raised portion in the heat exchanger illustrated in FIGS. 1A and 1B.

FIG. 2 is a perspective view of one example of the cut-raised portions 3. In the heat exchanger illustrated in FIGS. 1A and 1B, the upper-side and down-side edges in each of the two cut-raised portions 3, or the cut-raised portion pair, disposed on the upper side of the corresponding heat exchanger tube 2 are inclined inward while reducing the distance between the cut-raised portions 3, seeing from the upper side. That is, each of the cut-raised portions 3 is disposed to allow the second working fluid 4 to inflow from an upper-side opening of the cut-raised portion 3. Further, the down-side leg segment 3*a* of the cut-raised portion 3 is formed such that the outer surface thereof is disposed in opposed relation to the heat exchanger tube 2. For example, these cut-raised portions 3 are formed by subjecting the fin 1 to press working. As described later, a cut-raising inhibition zone 5 (FIG. 1 shows only one cut-raising inhibition zone 5) exists in the fin between two of the heat exchanger tubes adjacent to one another in the column direction.

Each of the heat exchanger tubes 2 of this heat exchanger is formed, for example of a metal pipe having an outer diameter (pipe diameter) of 7 mm or 9.52 mm. For example, a fin collar for holding the fin through the heat exchanger tubes 2 is formed to have a diameter (fin collar diameter) of about (pipe diameter×1.05+0.2 mm). The alignment pitch of the heat exchanger tubes 2 in the column direction is set, for example, of 20.4 mm or 22 mm. The alignment pitch of the heat exchanger tubes 2 in the row direction is set, for example, of 12.7 mm or 21 mm. It should be understood that all of these values are described simply by way of example, and the present invention is not limited to such values.

A spread width Ws of each of the cut-raised portion pairs 3 in the column direction is set to satisfy the relationship expressed by the following Formula 1:

$$Ws=(1-\phi)Dp+\phi D \qquad \text{Formula 1,}$$

wherein:

$\phi>0.5$,

D is an outer diameter of each of the heat exchanger tubes 2; and

Dp is an alignment pitch of the heat exchanger tubes in the column direction.

Thus, the cut-raising inhibition zone 5 exists in the fin between two of the heat exchanger tubes adjacent to one another in the column direction. Each of the cut-raised portion pairs is formed only in a region of the fin which falls within 130-degree, preferably 90-degree, in the central angle of the corresponding heat exchanger tube toward the upper side (±65-degree, preferably ±45-degree, on the basis of an axis passing through the center of the corresponding heat exchanger tube and extending in the row direction), and no cut-raised portion is formed in any region other than the above zone.

The function or action of the heat exchanger according to the first embodiment will be described below. During an usual operation of this heat exchanger, the cut-raised portions 3 formed in the fins 1 induces the segmentation or renewal of the a temperature boundary layer created in the second working fluid 4 flowing from the upper side (left side in FIG. 1) to provide enhanced heat exchange efficiency (heat transfer performance). During another operation of the heat exchanger under the condition causing frost buildup, frost is created and grown at and around each of the cut-raised portions 3 (hereinafter referred to as "vicinity of the cut-raised portion"). In conjunction with the frost buildup, a space between the adjacent fins 1 is gradually reduced and finally blocked up in the vicinity of the cut-raised portion.

However, in this heat exchanger, the cut-raising inhibition zone 5 exists in the fin 1, and the amount of frost buildup in the cut-raising inhibition zone 5 is reduced because the amount of frost buildup is increased in the vicinity of the cut-raised portion having high heat exchange efficiency. Thus, even if the frost buildup causes the reduction or blocking-up of the space between the adjacent fins 1 in the vicinity of the cut-raised portion, the second working fluid 4 can flow through the cut-raising inhibition zone 5 without difficulties. More specifically, in response to the reduction in flow volume of the second working fluid 4 in the vicinity of the cit-raised portion, the flow volume of the second working fluid 4 in the cut-raising inhibition zone 5 is increased to prevent the flow volume of the working fluid 4 from being reduced or restricted in terms of the entire heat exchanger so as to suppress the deterioration in heat exchange efficiency of the heat exchanger.

The relationship of the aforementioned Formula 1 will be described below. Given that, a width of the zone formed with no cut-raised portion in the surface region of the fin 1 between two of the heat exchanger tubes 2 adjacent to one another in the column direction is Wf, the Wf is expressed by the following Formula 2 using the parameter $\phi$:

$$Wf=\phi\times(Dp-D) \qquad \text{Formula 2}$$

Wf, Ws and Dp have a relationship expressed by the following Formula 3:

$$Wf+Ws=Dp \qquad \text{Formula 3}$$

Thus, Formula 3 can be transformed as follows:

$$Ws=(1-\phi)Dp+\phi D \qquad \text{Formula 4}$$

Figure 3:
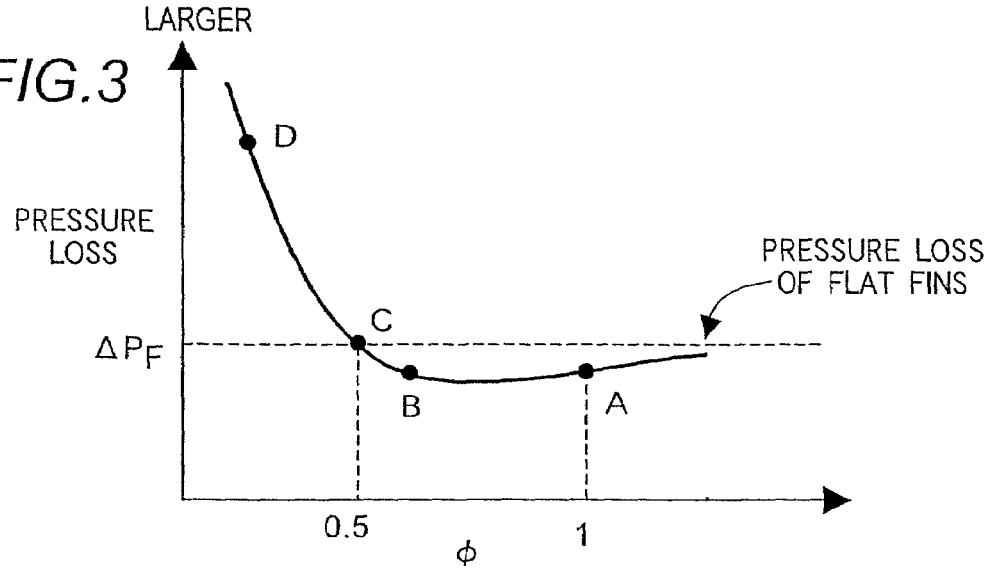
FIG. 3 is a graph showing the change in pressure loss of a heat exchanger relative to a parameter ϕ (see the after-mentioned Formula 1) in the operation of the heat exchanger under the condition causing frost buildup.

FIG. 3 shows the measurement result of the change in pressure loss under the condition that the parameter $\phi$ is varied while maintaining frost buildup in the above heat exchanger in the same state, by comparing with (standardizing using) the corresponding values in fins formed with no cut-raised portion (so-called flat fins).

Figure 4A:
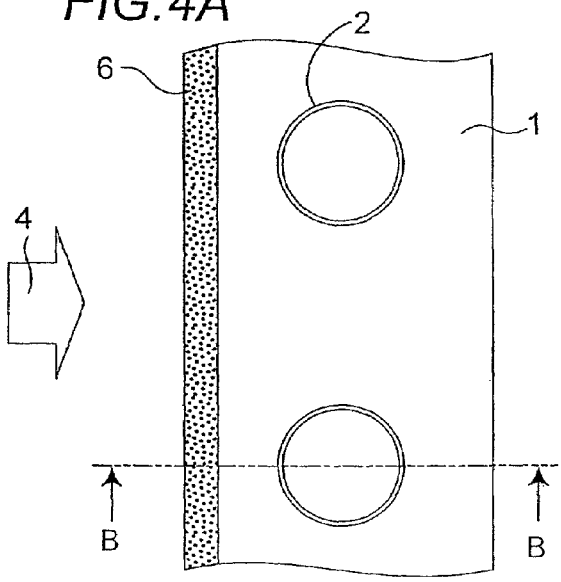
FIG. 4A is a schematic diagram of, a flat fin type heat exchanger in a frost-buildup state.
Figure 4B:
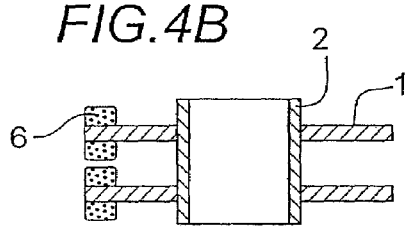
FIG. 4B is a sectional view taken along the line B-B in FIG. 4A.

FIGS. 4A and 4B show a frost buildup state in flat fins. As shown in FIGS. 4A and 4B, a frost 6 is primarily created along the edge of the fins on the upper side to cause the increase in pressure loss.

Figure 5A:
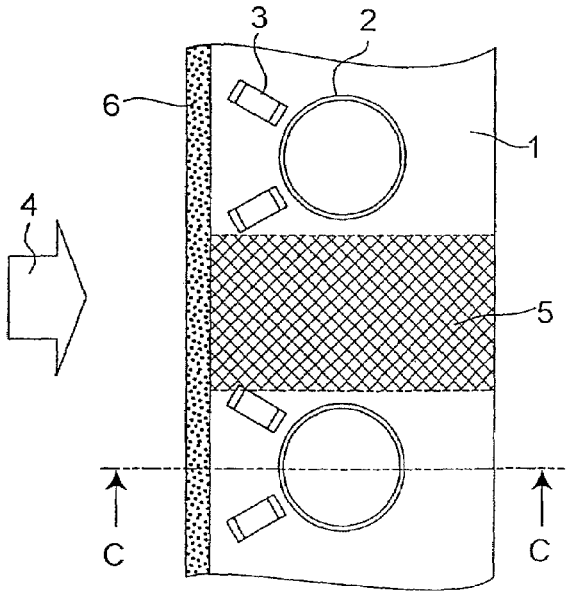
FIG. 5A is a schematic diagram of the heat exchanger illustrated in FIGS. 1A and 1B in a frost-buildup state.
Figure 5B:
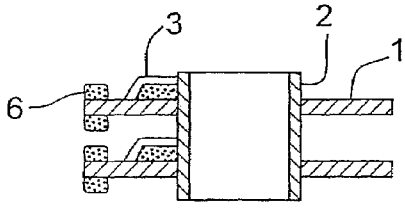
FIG. 5B is a sectional view taken along the line C-C in FIG. 5A.

FIGS. 5A and 5B show a frost buildup state in the fins 1 with the cut-raised portions 3 according to the first embodiment. As shown in FIGS. 5A and 5B, in the fins 1 according to the first embodiment, a frost 6 is created along the edge of the fins 1 on the upper side, and inside the cut-raised portions 3, to cause the increase in pressure loss.

In FIG. 3, Point A ($\phi=1$) indicates a pressure loss in case where the width Ws of the cut-raised pair 3 is equal to the outer diameter of the heat exchanger tube 2. At Point B ($\phi=0.6$), a frost 6 is primarily created and grown inside the cut-raised portions 3. Thus, the amount of frost buildup at the edge of the fins 1 is reduced, the second working fluid 4 can flow through the cut-raising inhibition zone 5 at a lower pressure loss than that in the flat fins. Then, the cut-raising inhibition zone 5 is gradually narrowed as the parameter $\phi$ is further reduced, and the value of pressure loss becomes greater than that in the flat fins at Pint C ($\phi=0.5$). Subsequently, the pressure loss of the heat exchanger is sharply increased as the parameter $\phi$ is further reduced. Therefor, the parameter $\phi$ is preferably set at a value of greater than 0.5 ($\phi>0.5$).

Figure 6A:
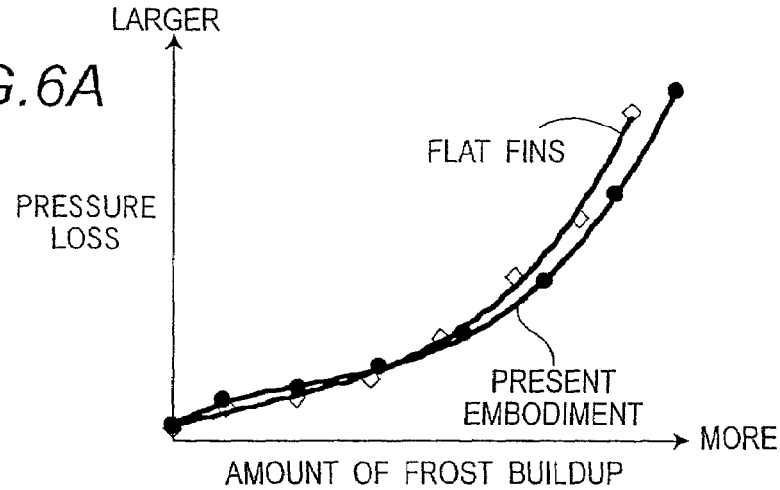
FIGS. 6A and 6B are graphs showing the change in pressure loss relative to the amount of frost buildup in case where each of different types of heat exchangers is operated under the condition causing frost buildup.

FIG. 6A shows the change in pressure loss relative to the amount of frost buildup in case where each of a flat fin type heat exchanger (flat fin type) and the heat exchanger according to the first embodiment (first embodiment type) is operated under the condition causing frost buildup.

Figure 6B:
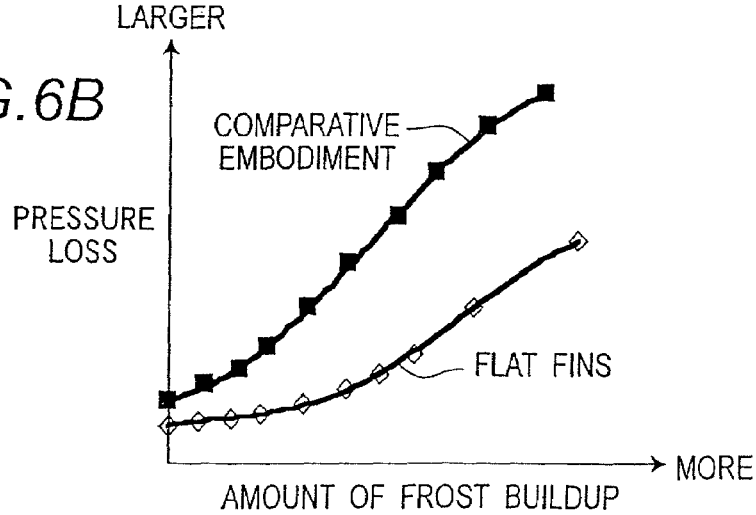

FIG. 6B shows the change in pressure loss relative to the amount of frost buildup in case where each of the heat exchanger with the cut-raised portions 3 formed between the adjacent heat exchanger tubes 2 in the column direction (comparative embodiment type), and the flat fin type heat exchanger (flat fin type) is operated under the condition causing frost buildup.

Figure 17:
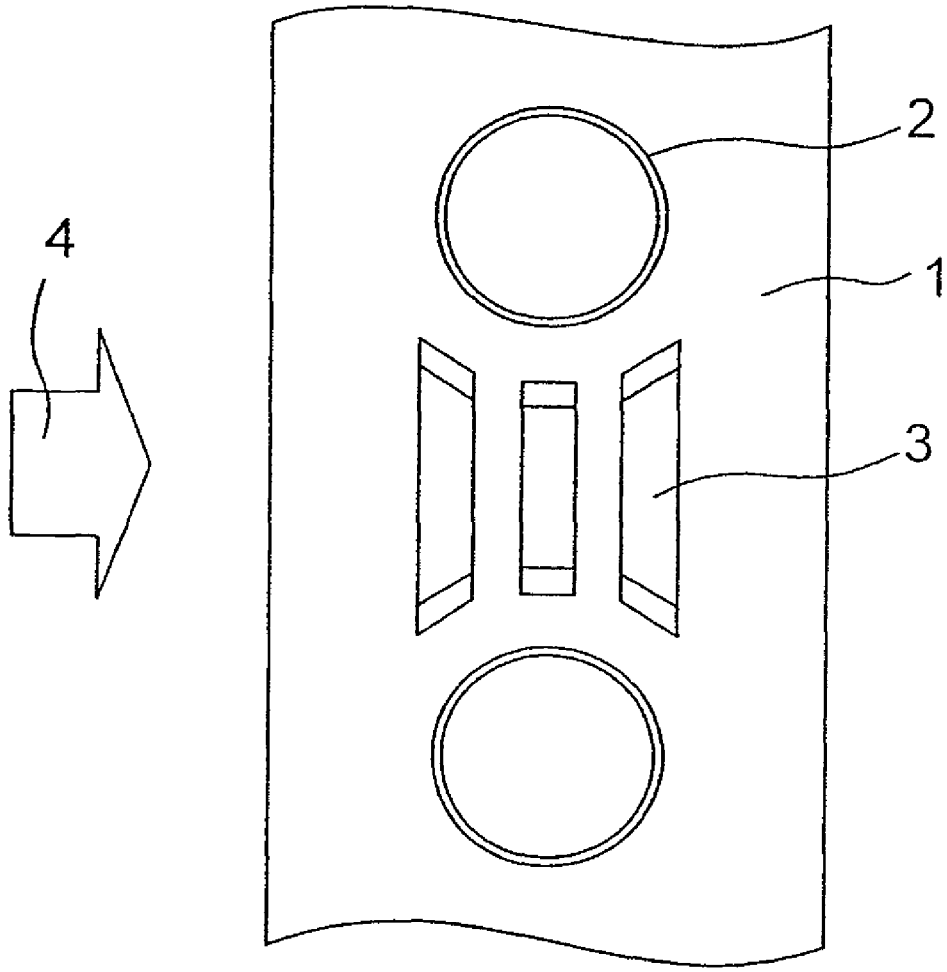
FIG. 17 is a schematic diagram of a plate fin and tube type heat exchanger as a comparative example, seeing from the side of one of the ends of a heat exchanger tube thereof.

As seen in FIGS. 6A and 6B, the increase in pressure loss in conjunction with progress of frost buildup in the heat exchanger according to the first embodiment is suppressed at a lower level than that in the flat fin type heat exchanger and the heat exchanger illustrated in FIG. 17. Thus, the flow volume of the working fluid 4 is prevented from being reduced or restricted in terms of the entire heat exchanger so as to suppress the deterioration in heat exchange efficiency of the heat exchanger.

Figure 7:
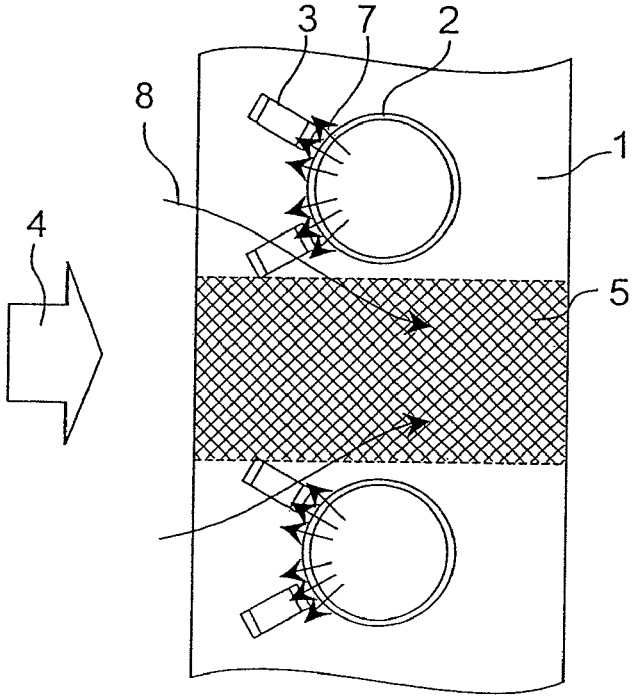
FIG. 7 is a schematic diagram showing a heat flow based on heat conduction in a fin around the heat exchanger tubes on the upstream side of a working fluid allowed to flow outside the heat exchanger tubes, and the streamline of the working fluid, in the heat exchanger illustrated in FIGS. 1A and 1B.

FIG. 7 is a schematic diagram showing a heat flow 7 based on heat conduction in the fin 1 around the heat exchanger tubes, and the streamline 8 of the second working fluid 4, in the heat exchanger illustrated in FIGS. 1A and 1B. As shown in FIG. 7, when heat is introduced from the heat exchanger tube 2 to the fin 1, the heat is radially transferred or diffused based on heat conduction. In case where heat is introduced from the fin 1 to the heat exchanger tube 2, the heat is also transferred based on heat conduction in the radial direction. That is, in the heat exchanger having the cut-raised portions 3 extending from the vicinity of the corresponding heat exchanger tube 2 in the radial direction as shown in FIG. 1, the direction of the heat transfer based on heat conduction around the heat exchanger tube approximately matched with the direction along which the heat exchanger tube 3 extends. Thus, the cut-raised portions 3 never hinder the heat transfer based on heat conduction in the fin 1 around the heat exchanger tube is not. This allows the heat transfer from the heat exchanger tubes 2 to the fin 1 based on heat conduction, or the heat transfer from the fin 1 to the heat exchanger tubes 2 based on heat conduction, to be smoothly performed so as to provide an increased amount of heat transfer in the fin.

Figure 8:
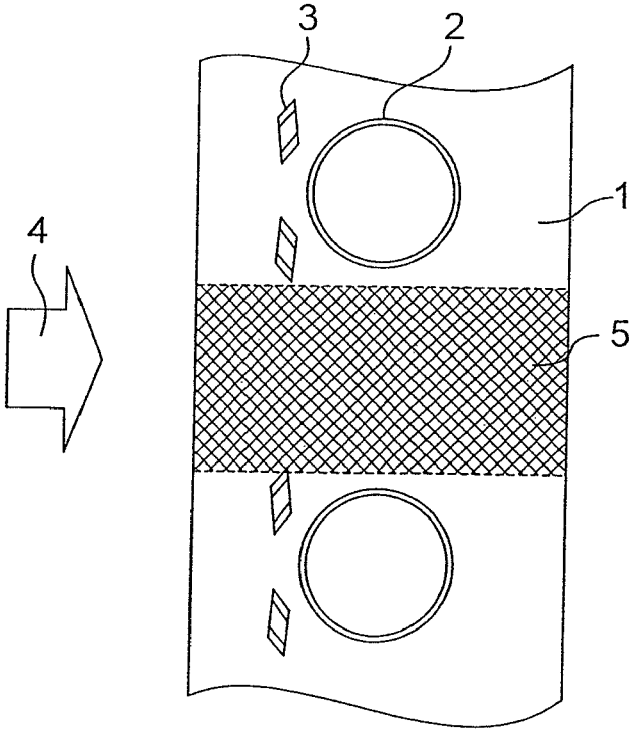
FIG. 8 is a schematic diagram of one modification of the heat exchanger according to the first embodiment of the present invention, seeing from the side of one of the ends of a heat exchanger tube thereof.

As shown in FIG. 8, instead of extending radially relative to the heat exchanger tube 2, the cut-raised portion 3 may be formed to extend obliquely relative to the column direction while allowing the outer surface of the leg segment 3*a* on the side of the heat exchanger tube to be disposed in opposed relation to the heat exchanger tube. In this case, the transfer path for the heat transfer from the heat exchanger tubes 2 to the fin 1 based on heat conduction, or the heat transfer from the fin 1 to the heat exchanger tubes 2 based on heat conduction, can also be assured. Thus, the amount of heat transfer in the fin can be increased.

The leg segments 3*a* of the cut-raised portion pair 3 also acts to divided the flow of the second working fluid 4 into two sub-flows on the upper side of the heat exchanger tubes 2, in such a manner that each of the sub-flows is inclined relative to the general flow direction (from left side to right side in FIG. 7) of the second working fluid 4 or in a direction getting away from the corresponding heat exchanger tube 2. Consequently, the two sub-flows of the second working fluid 4 distributed on both sides of the corresponding heat exchanger tube 2 are led toward the regions of the fin between the corresponding heat exchanger 2 and each of the two heat exchanger tubes adjacent thereto in the column direction, respectively. Thus, the flow of the second working fluid 4 on the entire surface of the fin is uniformed so that the effective heat transfer area of the fin 1 can be increased.

In addition, the respective edges of the pair of the cut-raised portion 3 are inclined inward to get close to one another, seeing from the upper-side edge of the fin 1, as described above. Thus, each of the two sub-flows of the second working fluid 4 enters from the opening defined by the edge of the cut-raised portion 3 into the cut-raised portion 3. This provides an enhanced effect of the cut-raised portion 3 on the segmentation or renewal of the temperature boundary layer to improve the heat exchange efficient (heat transfer coefficient) of the heat exchanger. Further, the cut-raised portion 3 extending radially relative to the corresponding heat exchanger tube 2 allows each of the two sub-flows of the second working fluid 4 to enters into the corresponding cut-raised portion 3 in a direction approximately orthogonal to the edge of the cut-raised portion 3 to maximize the effect of the cut-raised portion 3 on the segmentation or renewal of the temperature boundary layer.

While not illustrated, it is understood that even if the cut-raised portion pairs 3 are formed around the corresponding heat exchanger tubes on the down side, the heat transfer from the heat exchanger tubes 2 to the fin 1 based on heat conduction, or the heat transfer from the fin 1 to the heat exchanger tubes 2 based on heat conduction, can be smoothly performed, and the effect of the cut-raised portion 3 on the segmentation or renewal of the temperature boundary layer can be enhanced, in principle, as in the cut-raised portion pairs 3 formed around the corresponding heat exchanger tubes on the upper side.

As above, in the heat exchanger according to the first embodiment of the present invention, during the usual operation, the cut-raised portion pair 3 formed in the fin on the upper or down side of the heat exchanger tube 2 facilitates heat transport (heat transfer) between the fin 1 and the second working fluid 4 to provide enhanced heat exchange efficiency. This allows the heat exchanger to be reduced in size. During the operation under the conditions causing frost buildup, even if frost buildup causes the blocking-up (clogging) of the space between the adjacent fins 1 in the vicinity of the cut-raised portion, the second working fluid 4 can flow through the cut-raising inhibition zone 5 formed with no cut-raised portion to suppress the reduction in flow volume of the second working fluid 4 in terms of the entire heat exchanger. Thus, the heat exchange efficiency can be adequately maintained even during the operation under the frost-buildup conditions.

The cut-raised portion 3 with the edges extending obliquely relative to the column direction can divide the flow of the second working fluid 4 around the corresponding heat exchanger tube 2 into two sub-flows, and direct the two sub-flows toward the fin regions between the corresponding heat exchanger tube 2 and each of the two heat exchanger tubes 2 adjacent thereto in the column direction. This provides uniformed flow of the second working fluid 4 on the entire surface of the fin, and increased effective heat transfer area of the fin 1. Thus, the heat exchange efficiency of the heat exchanger is enhanced. Further, the edge of the cut-raised portion 3 is disposed approximately orthogonally to or in opposed relation to the flow of the second working fluid 4 to enhance the effect of the segmentation or renewal of the temperature boundary layer so as to facilitate heat transfer. Furthermore, the path of heat transfer from the heat exchanger tube 2 to the fin 1 based on heat conduction can be assured. Thus, the amount of heat transfer in the fin can be increased in the vicinity of the cut-raised portion to provide increased heat exchange energy in the entire heat exchanger.

Second Embodiment

Figure 9:
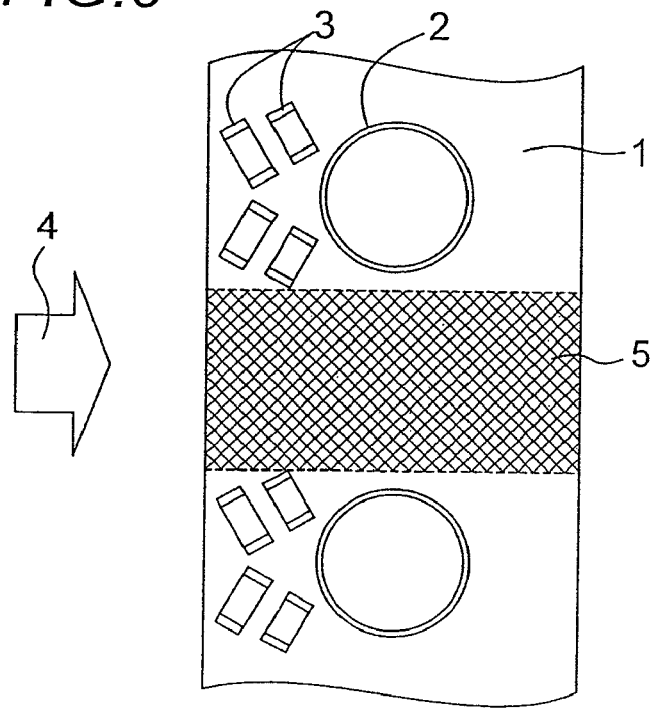
FIG. 9 is a schematic diagram of a heat exchanger according to a second embodiment of the present invention, seeing from the side of one of the ends of a heat exchanger tube thereof.

With reference to FIG. 9, a second embodiment of the present invention will be described. A heat exchanger according to the second embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 9, a common element or component to that of the heat exchanger illustrated in FIG. 1A is defined by the same reference numeral.

As shown in FIG. 9, fundamentally as with the first embodiment, the heat exchanger according to the second embodiment comprises a plurality of fins 1, a plurality of heat exchanger tubes 2, a plurality of cut-raised portions 3, and a plurality of cut-raising inhibition zones 5 (FIG. 9 shows only one of the cut-raising inhibition zones 5). The heat exchanger also be designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2.

Differently from the first embodiment, two cut-raised portion pairs (four cut-raised portions 3 in total) each fundamentally having the same structure as that of the cut-raised portion pair in the first embodiment are formed in the fin on the upper side of the corresponding one of the heat exchanger tubes 2 associated therewith, while being slightly spaced apart from one another in the row direction.

Other structures or arrangements are the same as those in the first embodiment.

The above heat exchanger according to the second embodiment can fundamentally bring out the same functions and effects as those in the first embodiment. In addition, the two cut-raised portion pairs 3 each fundamentally having the same structure as that of the cut-raised portion pair in the first embodiment are associated with the corresponding one of the heat exchanger tubes 2. Thus, the cut-raised portion pairs can provide enhanced heat exchange efficiency (heat transfer performance) during initial operation or usual operation.

While the second embodiment employs the two cut-raised portion pairs formed in the fin on the upper side of the corresponding heat exchanger tube 2 while being spaced apart from one another in the row direction, the number of the cut-raised portion pairs may be three or more.

Third Embodiment

Figure 10:
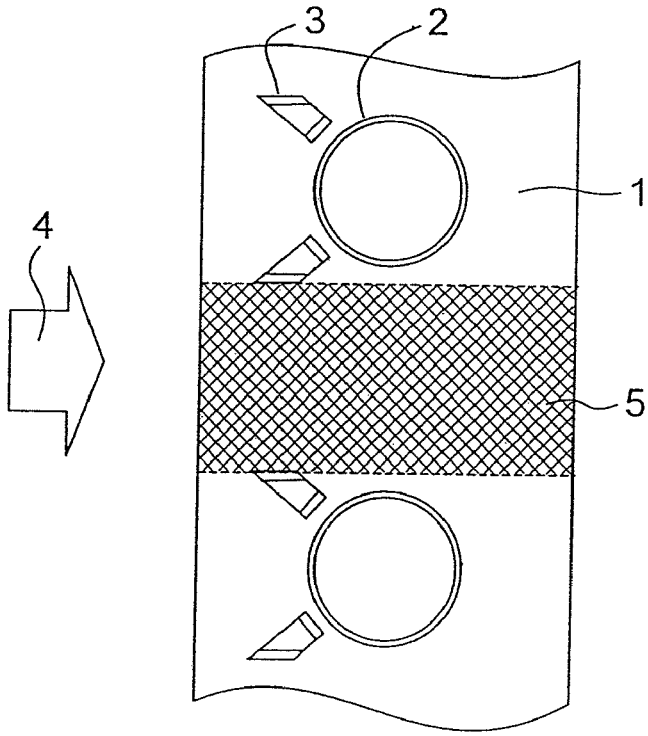
FIG. 10 is a schematic diagram of a heat exchanger according to a third embodiment of the present invention, seeing from the side of one of the ends of a heat exchanger tube thereof.

With reference to FIG. 10, a third embodiment of the present invention will be described. A heat exchanger according to the third embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 10, a common element or component to that of the heat exchanger illustrated in FIG. 1A is defined by the same reference numeral.

As shown in FIG. 10, fundamentally as with the first embodiment, the heat exchanger according to the third embodiment comprises a plurality of fins 1, a plurality of heat exchanger tubes 2, a plurality of cut-raised portions 3, and a plurality of cut-raising inhibition zones 5 (FIG. 10 shows only one of the cut-raising inhibition zones 5). The heat exchanger also be designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2.

Differently from the first embodiment, each of the cut-raised portions 3 has a leg segment 3*a* with opposite ends (hereinafter referred to as "side end") each connected to the body of the fin, and at least the upper-side one of the side edges is formed to extend in parallel with the row direction.

Other structures or arrangements are the same as those in the first embodiment.

The above heat exchanger according to the third embodiment can fundamentally bring out the same functions and effects as those in the first embodiment. In addition, at least one of the side edges of the leg segment 3*a* of the cut-raised portion 3 is formed in parallel with the flow direction of the second working fluid 4. Thus, the pressure loss to be caused by the collision between the second working fluid 4 and the leg segment 3*a* of the cut-raised portion 3 can be minimized to allow the flow volume of the second working fluid to be desirably increased.

Fourth Embodiment

Figure 11:
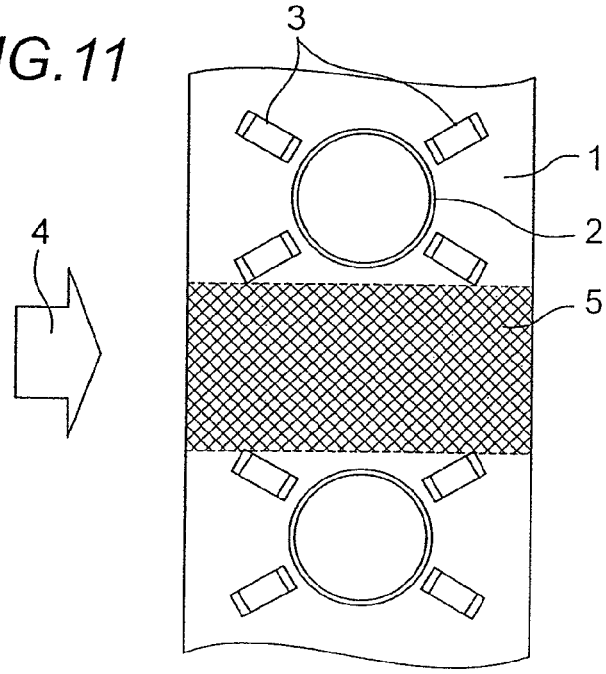
FIG. 11 is a schematic diagram of a heat exchanger according to a fourth embodiment of the present invention, seeing from the side of one of the ends of a heat exchanger tube thereof.

With reference to FIG. 11, a fourth embodiment of the present invention will be described. A heat exchanger according to the fourth embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 11, a common element or component to that of the heat exchanger illustrated in FIG. 1A is defined by the same reference numeral.

As shown in FIG. 11, fundamentally as with the first embodiment, the heat exchanger according to the fourth embodiment comprises a plurality of fins 1, a plurality of heat exchanger tubes 2, a plurality of cut-raised portions 3, and a plurality of cut-raising inhibition zones 5 (FIG. 11 shows only one of the cut-raising inhibition zones 5). The heat exchanger also be designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2.

Differently from the first embodiment, in each of the fins 1, two cut-raised portion pairs (four cut-raised portions 3 in total) each fundamentally having the same structure as that of the cut-raised portion pair in the first embodiment are formed, respectively, on both the upper and down sides of the corresponding one of the heat exchanger tubes 2. Preferably, the two cut-raised portion pairs formed on the upper and down sides are disposed symmetrically with respect to an axis connecting the respective centers of the plurality of heat exchanger tubes 2 aligned in the column direction.

Other structures or arrangements are the same as those in the first embodiment.

The above heat exchanger according to the fourth embodiment can fundamentally bring out the same functions and effects as those in the first embodiment. In addition, the two cut-raised portion pairs each fundamentally having the same structure as that of the cut-raised portion pair in the first embodiment are formed, respectively, on both the upper and down sides of the corresponding one of the heat exchanger tubes 2. Thus, in a press working for forming the two cut-raised portion pairs in a fin material, the deformation of the fin body can be reduced to facilitate manufacturing processes, such as an operation of stacking the fins.

Fifth Embodiment

Figure 12A:
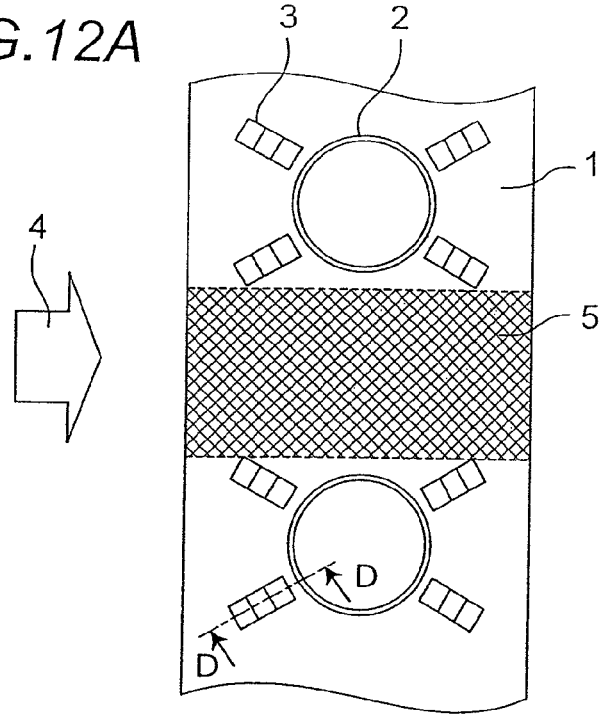
FIG. 12A is a schematic diagram of a heat exchanger according to a fifth embodiment of the present invention, seeing from the side of one of the ends of a heat exchanger tube thereof.
Figure 12B:
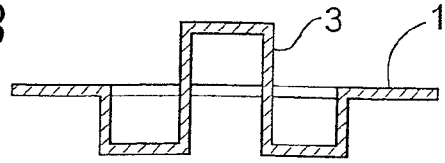
FIG. 12B is a sectional view taken along the line D-D in FIG. 12A.

With reference to FIGS. 12A and 12B, a fifth embodiment of the present invention will be described. A heat exchanger according to the fifth embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 12A, a common element or component to that of the heat exchanger illustrated in FIG. 1A is defined by the same reference numeral.

As shown in FIG. 12A, fundamentally as with the first embodiment, the heat exchanger according to the fifth embodiment comprises a plurality of fins 1, a plurality of heat exchanger tubes 2, a plurality of cut-raised portions 3, and a plurality of cut-raising inhibition zones 5 (FIG. 12A shows only one of the cut-raising inhibition zones 5). The heat exchanger also be designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2.

Differently from the first embodiment, each of the cut-raised portions 3 is formed to have a shape raised alternately vertically (in the longitudinal direction of the heat exchanger tubes) on the basis of the spread surface of the fin 1 (fin-space surface) or the body of the fin 1. More specifically, each of the cut-raised portions 3 is composed of an upper-side segment, an intermediate segment, and a down-side segment. The upper-side segment and the down-side segment are raised to be located on the underside of the spread surface of the fin 1, and the intermediate segment raised to be located above the spread surface of the fin 1. Other structures or arrangements are the same as those in the first embodiment. FIG. 12 is a sectional view of one example of the cut-raised portion 3, taken along the line D-D in FIG. 12A.

Generally, in a process of incorporating a heat exchanger in a certain unit, it is required to subject the heat exchanger to a bending process before instruction, in some cases. In the heat exchanger according to the fifth embodiment, each of the cut-raised portions has a shape raised alternately vertically, which serves as a structure supporting a load during the bending process by the contact points between the vertical face of the cut-raised portion and the surface of the fin 1. Thus, in the process of bending the heat exchanger in conformity to the shape of the unit, the deformation or slanting of the fin 1 can be suppressed to prevent the occurrence of damages in appearance and performance. It is obvious that the above heat exchanger according to the fifth embodiment can fundamentally bring out the same functions and effects as those in the first embodiment.

Sixth Embodiment

Figure 13:
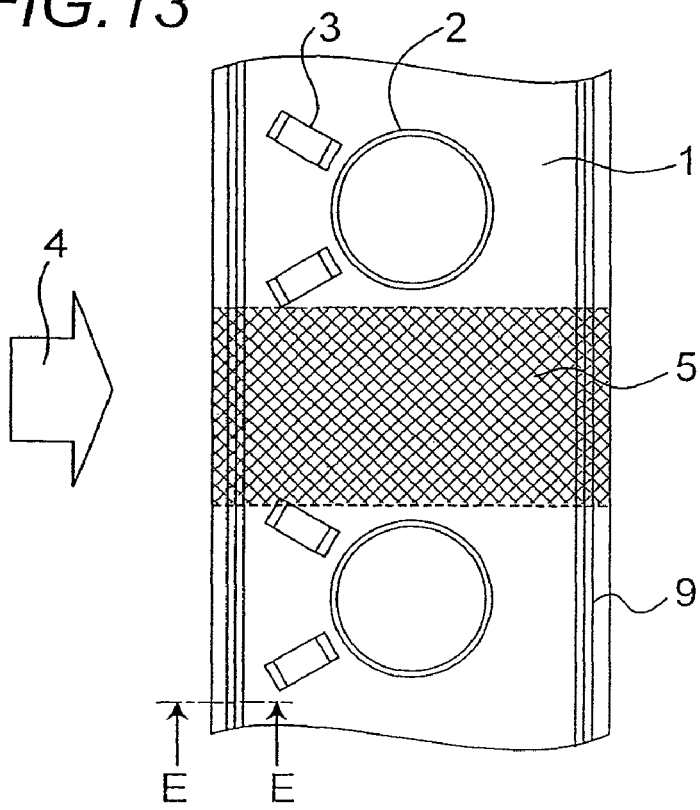
FIG. 13 is a schematic diagram of a heat exchanger according to a sixth embodiment of the present invention, seeing from the side of one of the ends of a heat exchanger tube thereof.

With reference to FIG. 13, a sixth embodiment of the present invention will be described. A heat exchanger according to the sixth embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 13, a common element or component to that of the heat exchanger illustrated in FIG. 1A is defined by the same reference numeral.

As shown in FIG. 13, fundamentally as with the first embodiment, the heat exchanger according to the sixth embodiment comprises a plurality of fins 1, a plurality of heat exchanger tubes 2, a plurality of cut-raised portions 3, and a plurality of cut-raising inhibition zones 5 (FIG. 13 shows only one of the cut-raising inhibition zones 5). The heat exchanger also be designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2.

Figure 14A:
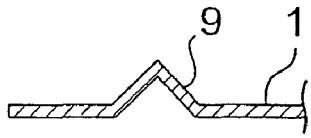
FIG. 14A is a sectional view taken along the line E-E in FIG. 13, which shows a convex-shaped protrusion in the heat exchanger illustrated in FIG. 13.
Figure 14B:
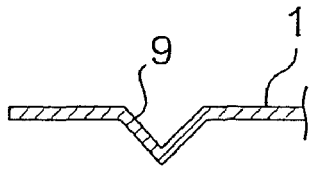
FIGS. 14B and 14C are sectional views showing modifications of the protrusion.
Figure 14C:
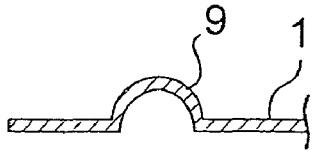

Differently from the first embodiment, each of the fins 1 in the sixth embodiment is formed with a convex-shaped protrusion 9 continuously extending in the column direction. The convex-shaped protrusion 9 may be formed, for example, through press working. FIGS. 14B and 14B are sectional views showing modifications of the protrusion.

The above heat exchanger according to the sixth embodiment can fundamentally bring out the same functions and effects as those in the first embodiment. In addition, the convex-shaped protrusion can provide a larger heat transfer area to the fin 1, and a higher strength to reduce the deformation of the fin so as to achieve the speeding-up in the process of stacking the fins 1.

Seventh Embodiment

Figure 15:
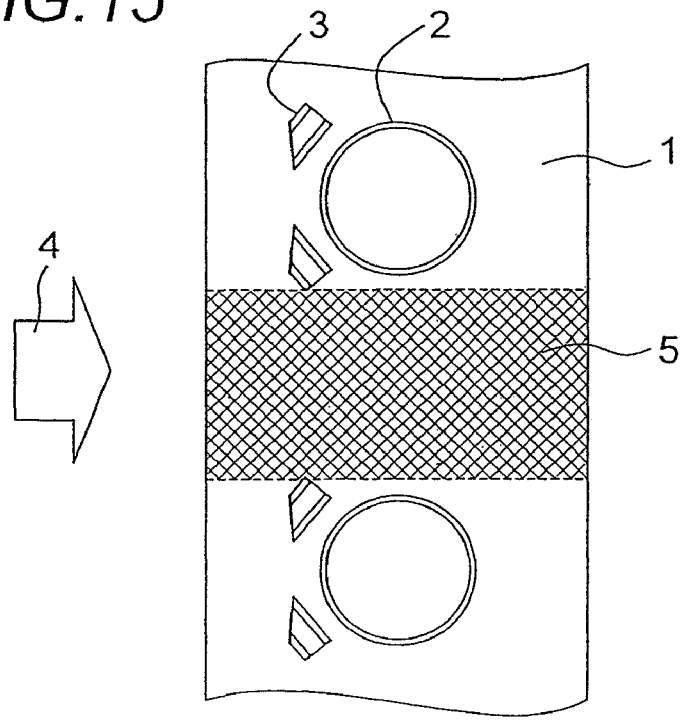
FIG. 15 is a schematic diagram of a heat exchanger according to a seventh embodiment of the present invention, seeing from the side of one of the ends of a heat exchanger tube thereof.

With reference to FIG. 15, a seventh embodiment of the present invention will be described. A heat-exchanger according to the seventh embodiment has a lot of common structures as those of the heat exchanger according to the first embodiment illustrated in FIGS. 1A to 7. For avoiding duplicate descriptions, the following description will be made by primarily focusing on different points from the first embodiment. In FIG. 15, a common element or component to that of the heat exchanger illustrated in FIG. 1A is defined by the same reference numeral.

As shown in FIG. 15, fundamentally as with the first embodiment, the heat exchanger according to the seventh embodiment comprises a plurality of fins 1, a plurality of heat exchanger tubes 2, a plurality of cut-raised portions 3, and a plurality of cut-raising inhibition zones 5 (FIG. 13 shows only one of the cut-raising inhibition zones 5). The heat exchanger is also designed to perform a heat exchange between a first working fluid (not shown) allowed to flow inside the heat exchanger tubes, and a second working fluid 4 allowed to flow outside the heat exchanger tubes, through the fins 1 and the heat exchanger tubes 2. The second working fluid 4 flows across the illustrated fin 1 from left to right in FIG. 15, i.e., from an upstream side to a downstream side of the fin 1.

Differently from the first embodiment, each of the cut-raised portions 3 includes first and second edges, the first edges being located closer to the downstream side of the corresponding fin 1 and having a length longer than the second edges of the respective cut-raised portions 3. The cut-raised portions 3 have trapezoidal shapes, viewed from the top surface of the fin 1. Other structures or arrangements are the same as those in the first embodiment. Thus, as shown in FIG. 15, the first edges of the cut-raised portions are disposed downstream of, in the flow direction of the second fluid 4, the second edges of the cut-raised portions. Each of the first edges of the cut-raised portions faces a corresponding one of the heat exchanger tube 2.

The above heat exchanger according to the seventh embodiment can fundamentally bring out the same functions and effects as those in the first embodiment. In addition, the edge located closer to the upper side end of the fin 1 has a larger length. Thus, this edge of the fin 1 can facilitate heat transfer to provide enhanced heat exchange efficiency. Further, the trapezoidal-shaped fin has a longer base. Thus, the heat flow from the heat exchanger tube 2 to the cut-raised portion 3 is increased to provide further enhanced heat exchange efficiency.

Figure 16:
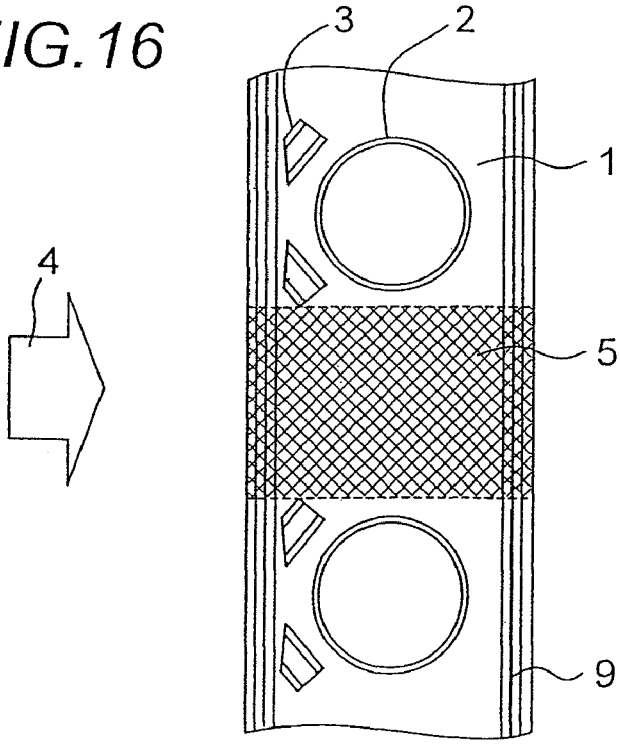
FIG. 16 is a schematic diagram of one modification of the heat exchanger according to the seventh embodiment of the present invention, seeing from the side of one of the ends of a heat exchanger tube thereof.

As shown in FIG. 16, a convex-shaped protrusion 9 may be formed in the fin 1. In this case, even if only a limited space exists between the upper-side end of the fin 1 and the heat exchanger tube 2, the area of the fin 1 can be sufficiently to improve the heat exchange efficiency.

While the present invention has been described in conjunction with specific embodiments, various modifications and alterations will become apparent to those skilled in the art. Therefore, it is intended that the present invention is not limited to the illustrative embodiments herein, but only by the appended claims and their equivalents.

INDUSTRIAL APPLICABILITY

As mentioned above, the plate fin and tube type heat exchanger according to the present invention is useful as a heat exchanger to be used under the conditions causing frost buildup, and suitable particularly as a condenser for air-conditioners.

The invention claimed is:

1. A heat exchanger including plate fins and tubes comprising:

a plurality of fins stacked at respective intervals; and a plurality of heat exchanger tubes penetrating each of said fins in a fin-stacking direction, said heat exchanger exchanging heat between a first fluid flowing inside said heat exchanger tubes and a second fluid flowing outside said heat exchanger tubes, wherein each of said fins includes a main body that is substantially planar and a plurality of cut-raised portions extending from said main body and disposed at an upstream side of flow of the second fluid with respect to said heat exchanger tubes, and each of said cut-raised portions corresponds to a respective heat exchanger tube and includes first and second opposed side ends connected to the main body of said fin, wherein the first side end is nearer to the corresponding heat exchanger tube than is the second side end, the first side end is longer than the second side end, the first side end is disposed downstream, in the flow of the second fluid, of the second side end, facing the corresponding heat exchanger tube, and the first and second side ends of each of said cut-raised portions are parallel to the each other.

2. The heat exchanger according to claim 1, wherein each of said cut-raised portions has two opposite edges disconnected from said main body of the corresponding fin, and at least one of said first and second edges extends in a radial direction of the corresponding heat exchanger tube.

3. The heat exchanger according to claim 1, including a further cut-raised portion having two opposed side ends connected to said main body of the corresponding fin, wherein at least one of said side ends of said further cut-raised portion extends in a direction perpendicular to the column direction.

4. The heat exchanger according to claim 1, including at least two of said cut-raised portions for each of said heat exchanger tubes, said cut-raised portions being disposed symmetrically with respect to an axis that passes through the center of the corresponding heat exchanger tube and that extends in a direction perpendicular to the column direction.

5. The heat exchanger according to claim 1, wherein each of said fins includes a convex protrusion continuously extending in the column direction.

6. The heat exchanger according to claim 1, wherein said first and second opposed edges are not directly connected to said main body of said fin, said first edge being longer than said second edge.

* * * * *